US011905859B2

(12) United States Patent
Radulescu et al.

(10) Patent No.: US 11,905,859 B2
(45) Date of Patent: Feb. 20, 2024

(54) CASTELLATION ASSEMBLY, LASH CAPSULE, AND ROCKER ARM

(71) Applicant: Eaton Intelligent Power Limited, Dublin (IE)

(72) Inventors: Andrei D. Radulescu, Marshall, MI (US); Ramy Rezkalla, Kalamazoo, MI (US); Daniel Nelson, Kalamazoo, MI (US); James Sheren, Grand Ledge, MI (US); Michele Angelo Cecchi, Turin (IT); Marco Ravoni, Rome (IT); Maria Letizia Ciardullo, Cosenza (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/800,072

(22) PCT Filed: Feb. 19, 2021

(86) PCT No.: PCT/EP2021/025069
§ 371 (c)(1),
(2) Date: Aug. 16, 2022

(87) PCT Pub. No.: WO2021/164948
PCT Pub. Date: Aug. 26, 2021

(65) Prior Publication Data

US 2023/0102765 A1 Mar. 30, 2023

Related U.S. Application Data

(60) Provisional application No. 63/014,903, filed on Apr. 24, 2020, provisional application No. 62/978,815, filed on Feb. 19, 2020.

(51) Int. Cl.
*F01L 1/18* (2006.01)
*F01L 1/20* (2006.01)
(Continued)

(52) U.S. Cl.
CPC ..... *F01L 1/181* (2013.01); *F01L 1/20* (2013.01); *F01L 13/065* (2013.01);
(Continued)

(58) Field of Classification Search
CPC ..... F01L 1/181; F01L 1/20; F01L 1/22; F01L 1/46; F01L 13/0005; F01L 13/065;
(Continued)

(56) References Cited

U.S. PATENT DOCUMENTS 3,791,355 A 2/1974 Bergmann et al.
4,200,081 A 4/1980 Meyer et al.
(Continued)

FOREIGN PATENT DOCUMENTS

CN 107420147 A 12/2017
CN 109328258 A 2/2019
(Continued)

OTHER PUBLICATIONS

International Search Report and Written Opinion for PCT/EP2021/025069; dated Jun. 1, 2021; pp. 1-8.
(Continued)

*Primary Examiner* — Kenneth J Hansen
*Assistant Examiner* — Kelsey L Stanek
(74) *Attorney, Agent, or Firm* — Baker Botts L.L.P.

(57) ABSTRACT

A castellation assembly comprises a lost motion spring assembly, an upper castellation piece, and a lower castellation piece. A spring hat comprises a crown, a pin hole through the crown, and a brim. A lost motion spring is seated against the spring hat. Upper castellation piece comprises a tubular body, an upper inner rim adjoining the brim, and upper castellation teeth. Lower castellation piece comprises a spring post extending up from a castellation body, the spring post passing through the lost motion spring, and through the pin hole. Lower castellation teeth extend from
(Continued)

the castellation body. The lost motion spring is biased against the castellation body to lift the upper inner rim by the brim. A lash screw can house the spring post so that the spring post terminates inside the lash screw. A rocker arm is an example of a castellation assembly installation.

14 Claims, 5 Drawing Sheets

(51) Int. Cl.
*F01L 13/06* (2006.01)
*F01L 1/46* (2006.01)
*F01L 13/00* (2006.01)

(52) U.S. Cl.
CPC ... *F01L 2001/467* (2013.01); *F01L 2013/001* (2013.01); *F01L 2013/105* (2013.01); *F01L 2305/00* (2020.05)

(58) Field of Classification Search
CPC ..... F01L 2001/467; F01L 2013/001; F01L 2013/105; F01L 2305/00
USPC ..... 123/90.39, 90.45, 90.52
See application file for complete search history.

(56) References Cited

U.S. PATENT DOCUMENTS 4,227,494 A 10/1980 Uitvlugt
5,409,338 A 4/1995 McKinlay
6,273,039 B1 8/2001 Church
6,273,057 B1 8/2001 Schwoerer et al.
6,354,265 B1 * 3/2002 Hampton ..... F01L 1/181 123/321
6,971,366 B2 12/2005 Funke et al.
7,246,587 B2 7/2007 Evans et al.
8,001,939 B2 8/2011 Hathaway
8,573,171 B2 11/2013 Cecur et al.
8,726,863 B2 5/2014 Meistrick et al.
10,132,205 B2 11/2018 Lahr
10,190,451 B2 1/2019 Meneely et al.
10,260,386 B2 4/2019 Andrisani et al.
10,851,717 B2 12/2020 Groth et al.
2008/0202455 A1 8/2008 Diggs
2008/0314347 A1 12/2008 Ng
2015/0159520 A1 * 6/2015 Cecur ..... F01L 1/181 123/90.12
2017/0009610 A1 1/2017 Ahmed
2017/0051638 A1 2/2017 Cecur
2017/0051639 A1 2/2017 Cecur
2018/0187579 A1 * 7/2018 Cecur ..... F01L 1/18
2019/0063268 A1 2/2019 Buonocore et al.
2020/0325803 A1 * 10/2020 Patil ..... F01L 1/181
2022/0145781 A1 * 5/2022 DiMaro ..... F01L 1/20

FOREIGN PATENT DOCUMENTS

CN 109923286 A 6/2019
EP 3296531 A1 3/2018
JP 2007146783 A 6/2007
JP 2008286000 A 11/2008
JP 4771168 B2 9/2011
WO 2009107577 A1 9/2009
WO 2009145169 A1 12/2009
WO 2014001560 A1 1/2014
WO 2016207348 A1 12/2016
WO 2019036272 A1 2/2019
WO WO 2019036272 A1 2/2019
WO 2019133658 A1 7/2019
WO WO-2019133658 A1 * 7/2019 ..... F01L 1/181
WO WO 2019133658 A1 7/2019
WO WO 2019228671 A1 12/2019
WO 2020173607 A1 9/2020

OTHER PUBLICATIONS

CN OA for Chinese Application No. 202180015170.5 dated Mar. 31, 2023, 10 pages.
CN NOA received for Chinese Application No. 2021800151705, dated Nov. 17, 2023, 6 pages.

* cited by examiner

CASTELLATION ASSEMBLY, LASH CAPSULE, AND ROCKER ARM

This is a United States § 371 National Stage Application of PCT/EP2021/025069 filed Feb. 19, 2021 and claims the benefit of U.S. provisional application 63/014,903 filed Apr. 24, 2020 and claims the benefit of U.S. provisional application 62/978,815 filed Feb. 19, 2020, all of which are incorporated herein by reference.

FIELD

This application provides a castellation assembly usable in a variety of valvetrain actuations, and particularly in a rocker arm. The castellation assembly can be configured with a lash screw to facilitate compact packaging. A lost motion spring assembly facilitates a floating castellation piece.

BACKGROUND

Rocker arm systems, valvetrain systems, rocker arms, and valve actuating assemblies herein can comprise alternative castellation mechanisms such as those described in, for example, WO 2019/133658, WO 2019/036272, US2020/0325803, US2018/0187579, U.S. Pat. Nos. 4,227,494, 6,354,265, 6,273,039, & 4,200,081. The castellation device disclosed herein can be used in rocker arm systems, valvetrain systems, rocker arms, and valve actuating assemblies such as those disclosed in these same exemplary publications.

SUMMARY

The methods and devices disclosed herein improve the art by way of a castellation assembly with easy actuation enabled by a floating castellation arrangement. A compact design with lash adjustment is achieved by housing a portion of the castellation assembly within the lash screw.

A castellation assembly comprises a lost motion spring assembly, an upper castellation piece, and a lower castellation piece. A spring hat comprises a crown, a pin hole through the crown, and a brim. A lost motion spring is seated against the spring hat. Upper castellation piece comprises a tubular body, an upper inner rim adjoining the brim, and upper castellation teeth. Lower castellation piece comprises a spring post extending up from a castellation body, the spring post passing through the lost motion spring, and through the pin hole. Lower castellation teeth extend from the castellation body. The lost motion spring is biased against the castellation body to lift the upper inner rim by the brim. The upper castellation piece can be biased by the lost motion spring assembly to float above the castellation body of the lower castellation piece.

A lash screw can house the spring post so that the spring post terminates inside the lash screw. Lash screw can comprise a first outer diameter of a lash screw body configured to seat in a lash-setting bore. A second outer diameter of the lash screw body can be configured to extend out of the lash-setting bore. An inner guiding bore can comprise a first inner diameter and a second inner diameter stepped from the first inner diameter. The lost motion spring assembly can be seated against the first inner diameter. The spring post can extend up from the castellation body into the second inner diameter.

The spring post can terminate inside the second inner diameter. This gives the castellation assembly a compact size. When installed in a rocker arm, no moving post juts from the rocker arm. Only the lash-setting lash screw and its mounting hardware jut from the rocker arm, creating a durable package.

To facilitate the formation of a lash capsule comprising the castellation assembly, the lash screw can be configured so that the second outer diameter steps down from the first outer diameter. The lash screw can serve as an upper limit for the lost motion spring assembly, and the upper castellation piece can biased by the lost motion spring assembly to float above the castellation body of the lower castellation piece, with the spring hat seated in the lash screw.

The floating castellation design facilitates easy actuation. The upper castellation piece does not drag against the lower castellation piece. Alternative actuators can be configured, including mechanical, electromechanical, and hydraulic. Hydraulic actuation is shown herein. The tubular body can comprises an exterior actuator slot configured to interface with a movable piston. Or, the tubular body can comprise exterior pinion teeth configured to interface with a movable, toothed rack. Then, as an alternative, rocker arm can comprise an actuation bore and a rack gear biased in the actuation bore. The tubular body can comprises an external pinion gear portion aligned with the rack gear.

A rocker arm is an example of a castellation assembly installation. Castellation assembly can be installed in a capsule bore, wherein the capsule bore comprises a lash setting bore and an actuation bore. The first outer diameter is seated in the lash setting bore, and the upper castellation piece and the lower castellation piece are seated in the capsule bore.

A rocker arm can comprise the castellation assembly installed in a capsule bore of a capsule body. The first outer diameter can be seated in the capsule bore. The second outer diameter can extend out of the actuation bore.

Securing the castellation capsule to the rocker arm in a compact and durable manner can be accomplished in alternative ways. In a first alternative, a washer is seated against the capsule body and partially surrounds the second outer diameter. A locking assembly is seated against the washer. A nut is threaded to the second outer diameter and secures the locking assembly against the washer.

The washer can comprise a toothed star washer. The rocker arm can comprise a stake pressed between teeth of the star washer and into the capsule body. Or, the rocker arm can comprise a stake pressed through the star washer and into a shoulder of the lash screw.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1:
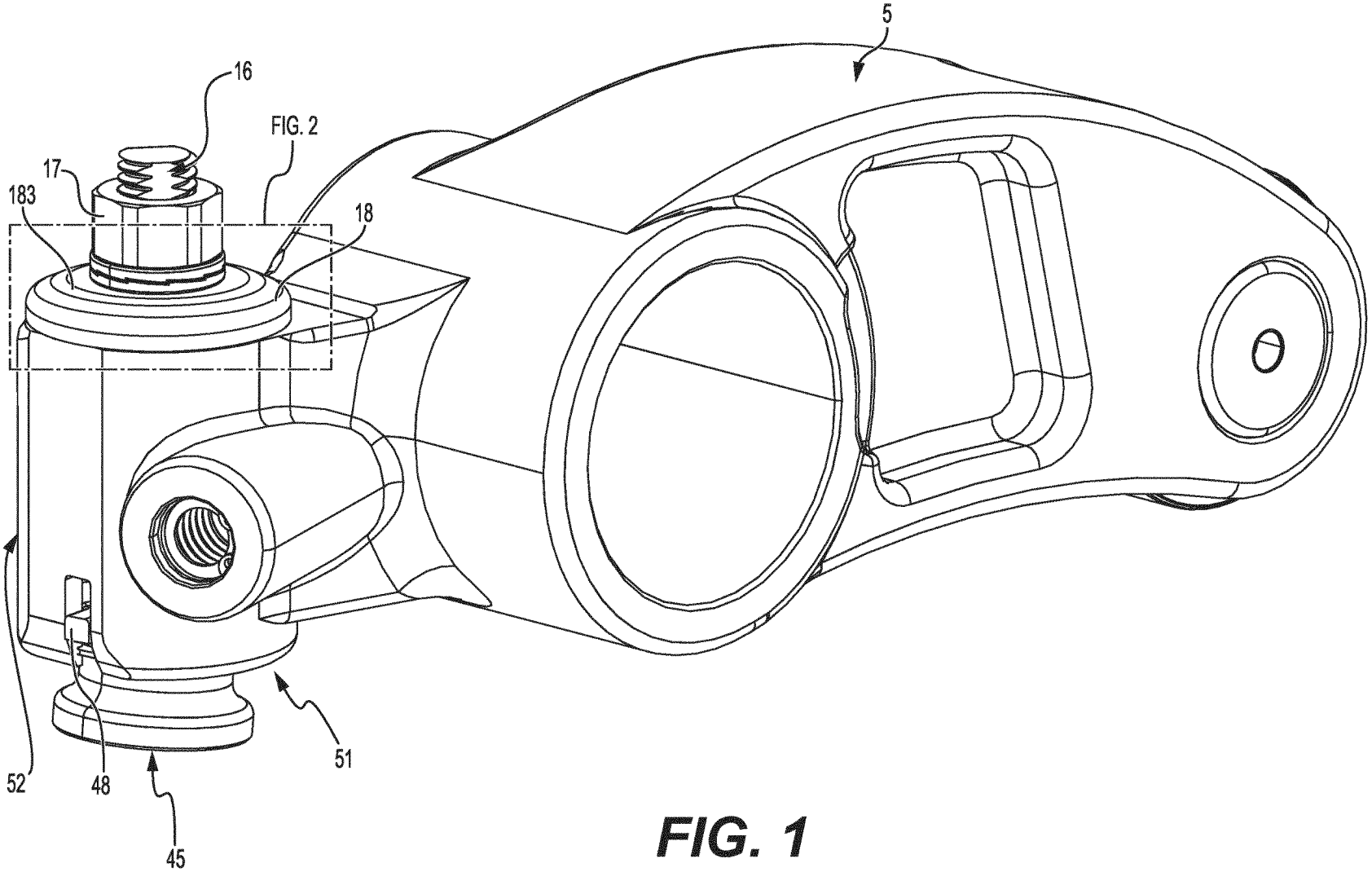
FIG. 1 is an example of a compatible rocker arm.
Figure 2:
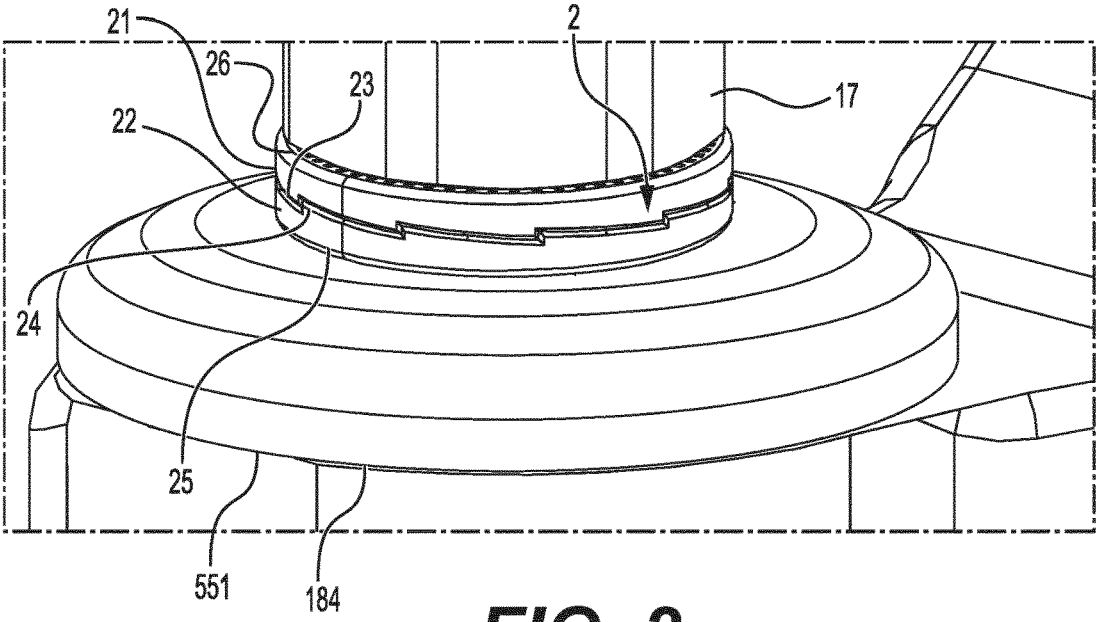
FIG. 2 shows fasteners including a locking assembly.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

The disclosure herein provides a compact castellation assembly 100 with a stepped lash screw for increased strength. A small counter nut 17 provides for reduced packaging. A lock assembly 2, which can comprise Nord Lock style washers 221, 222, can be used to maintain thread pre-tension on the lash screw 1 and prevent loosening of the castellation assembly 100.

In some cylinder valve applications where the valves are oriented perpendicular to the rocker shaft, packaging a dedicated brake arm between two cylinder deactivation ("CDA") arms is challenging. In a design where the exhaust arm goes around the brake arm, packaging space is small. An additional packaging challenge arises when the CDA exhaust arm is using a deactivation capsule positioned over the rocker shaft due to the size and position of the CDA capsule and the clearance issue to the brake capsule. Other times, a valve cover is applied, and that requires the operational footprint of the rocker arm to be small. It is beneficial to eliminate any need to account for a castellation pin rising up out of the rocker arm.

So, the castellation assembly 100 disclosed herein, and combination with a lash screw 1, can be used in a variety of rocker arms and valvetrain actuation techniques. It is also usable outside of rocker arms and valvetrains, and can be used in other systems where castellation actuation is desirable.

In the valvetrain aspect of the disclosure, the castellation assembly 100 can be used in single or dual or other plural rocker arm systems. The castellation assembly 100 can enable switching among various valve lift profiles. For example, the castellation assembly 100 can be used to extend the duration of valve lift when the castellation teeth 43, 76 are engaged. Or, engine braking ("EB") can be enabled. Lost motion spring assembly 3 can be used to absorb a lost valve lift profile when the castellation teeth 43, 76 are not aligned for techniques such as cylinder deactivation ("CDA"). Or, a first lift profile can be transferred to the valves when the castellation teeth are not aligned, and a second, longer lift profile can be transferred to the valves when the castellation teeth are aligned. Strategies such as late intake valve closing, early intake valve opening, early exhaust valve opening, negative valve overlap, etc. (LIVC, EIVO, EEVO, NVO), among others, can also be implemented.

Whether a first rocker arm or a second rocker arm provides a main lift profile, or whether an added motion, engine braking or cylinder deactivation are provided by the first rocker arm or the second rocker arm is a matter of design choice. So, the valvetrain components can be arranged so that a main lift is provided by a first rocker arm, and a second rocker arm, outfitted with a switchable castellation assembly 100 provides an additional valve lift function to the engine valves. As another example, the engine can be equipped with a main rocker for main valve lift, and a secondary rocker for the secondary valve lift. The secondary rocker arm can incorporate a switchable lost motion mechanism in the form of the castellation assembly 100, so that when it is switched in off mode it will absorb the motion received by the cam, so that no motion will be transferred to the valve. When the switching mechanism will be turned on, the cam motion will be transferred from the secondary rocker arm to the main rocker arm. The main rocker arm can have a surface designed to receive the force from the secondary rocker arm. The surface can be a lateral cantilever or other part on the main rocker arm.

With the alternatives in mind, a plain rocker arm 5 is shown in the Figures for the sake of an illustrated example. Rocker arm 5 comprise a cam end, a rocker shaft bore, and a valve end 51. In this example, the castellation assembly 100 is placed in the valve end 51. A capsule bore 52 is formed in a capsule body 551 of the valve end 51 to comprise a lash setting bore 54 that can be threaded or otherwise suited for gripping the lash screw 1 for lash setting. A sliding bore 53 is included for sliding motion of the upper and lower castellation pieces 7, 4. An actuation bore 55 can adjoin the capsule bore 52 for actuating the castellation assembly 100. A notch or groove for a snap ring, clip 47, or other fastener can be included in the capsule bore 52. Clip 47 can retain the lower castellation piece 4 in position during shipment and assembly.

The switchable mechanism is a mechanical castellation capsule. It can be drop-in assembled in the rocker arm 5. The lash screw 1 can be placed in the capsule bore 52 and the castellation assembly 100 can be dropped into the lash screw 1. An alignment step can be made before or after the castellation assembly 100 is placed in the capsule bore 52, as by setting the lash of the lash screw 1. Flats 16 can be included on the lash screw 1 to facilitate the lash setting. Flats 16 or other indexing features can be placed on the second outer diameter 12 to hold the lash screw 1 in position when setting lash and to provide support when setting the tension with the counter nut 17. Now, brake lash setting can be done using an external tool. So, the disclosure is compatible with other capsule or cartridge-receiving rocker arms and valvetrain components.

A castellation assembly 100 comprises a lost motion spring assembly 3, an upper castellation piece 7, and a lower castellation piece 4. A spring hat 31 comprises a crown 33, a pin hole 34 through the crown 33, and a brim 35. A crown height can be set by a side band 32. A lost motion spring 30 can be seated against the spring hat, either within the crown 33 or against the brim 35. Upper castellation piece 7 comprises a tubular body 71. An upper inner rim 72 can be configured to adjoin the brim 35 so that the tubular body 71 hangs from the brim 35 when the lost motion spring 30 pushes against the spring hat 31. The brim 35 and the upper inner rim 72 form a rim-to-rim contact. By hanging the upper castellation piece 7 from the brim 35, the lost motion spring 30 can be long and can have a good separation force. Upper castellation teeth 76 can also be formed in the tubular body 71. A hollow middle portion 74 can surround a portion of the lost motion spring 30. Optional lower inner rim 73 can guide the lost motion spring 30. Tubular body 71 also can comprise, as alternatives, an actuator slot 751 or pinion teeth 75, as discussed more below, among other actuation options.

Lower castellation piece 4 comprises a spring post 41 extending up from a castellation body 42. The spring post 41 can be configured to pass through the lost motion spring 30 and through the pin hole 34. The pin hole 34 can be sized and shaped to guide the spring post 41 and to facilitate sliding therethrough. Spring post 41 can guide lost motion spring 30 against buckling. This creates a compact lower castellation design. Lower castellation teeth 43 extend from the castellation body 42 to either engage with the upper castellation teeth 76 or to slide between the upper castellation teeth 76, as switching control is applied. The lost motion spring 30 is biased against the castellation body 42 to lift the upper inner rim 42 by the brim 35. Hence, the upper castellation piece 7 can be biased by the lost motion spring assembly 3 to float above the castellation body 42 of the lower castellation piece 4. Additional features can be applied to the lower castellation piece 4, including a knurl 44 for accepting an e-foot (elephant foot) attachment 45. Castellation body 42 can comprise a spring seat 46 such as a groove or rim or other spring locating feature.

A lash screw 1 can house the spring post 41 so that the spring post 41 terminates inside the lash screw 1. The rocker arm 5 can seat the lash screw 1 to set the lash of the rocker arm 5. The lash screw 1 is sized to resist the high operation loads when the engine is in decompression brake mode. To facilitate this resistance, a stepped lash screw 1 provides a large enough first outer diameter ("OD") 11 to support the brake loads and a small second outer diameter 12, which can be threaded to allow for a small counter nut 17 to help with packaging. The lash body 10 having a stepped design, it can be light weighted while accomplishing its load resistance and positioning functions.

Lash screw 1 can comprise a first outer diameter 11 of a lash screw body 10 configured to seat in a lash-setting bore 54. A second outer diameter 12 of the lash screw body 10 can be configured to extend out of the lash-setting bore 54. An inner guiding bore 19, which can be a pilot hole, can also be stepped to comprise a first inner diameter 13 and a second inner diameter 14 stepped-in from the first inner diameter 13. The guiding bore 19 can orient the spring hat 31 and the spring post 41 and facilitate radial alignment. The lost motion spring assembly 3 can be seated against the first inner diameter 13. The spring post 41 can extend up from the castellation body 42 into the second inner diameter 14.

The spring post 41 can terminate inside the second inner diameter 14. This gives the castellation assembly 100 a compact size. When installed in a rocker arm 5, no moving post juts from the rocker arm 5. Only the lash-setting lash screw 1 and its fastening hardware jut from the rocker arm 5, creating a durable package.

To facilitate the formation of a lash capsule comprising the castellation assembly 100, the lash screw 1 can be configured so that the second outer diameter 12 steps down from the first outer diameter 11. The lash screw 1 can serve as an upper limit for the lost motion spring assembly 3, and the upper castellation piece 7 can biased by the lost motion spring assembly 3 to float above the castellation body 42 of the lower castellation piece 4, with the spring hat 31 seated in the lash screw 1.

When the castellation assembly 100 is in a collapsing mode, the upper castellation teeth 76 are aligned to the cavities between the lower castellation teeth 43 so as to deliver the lost motion function. To turn on a secondary or other valve lift, an actuation assembly 6, 8 can be actuated. Both actuation assemblies are hydraulic in this disclosure, though other actuation assemblies are not excluded from being combined with the castellation assembly 100.

Figure 3:
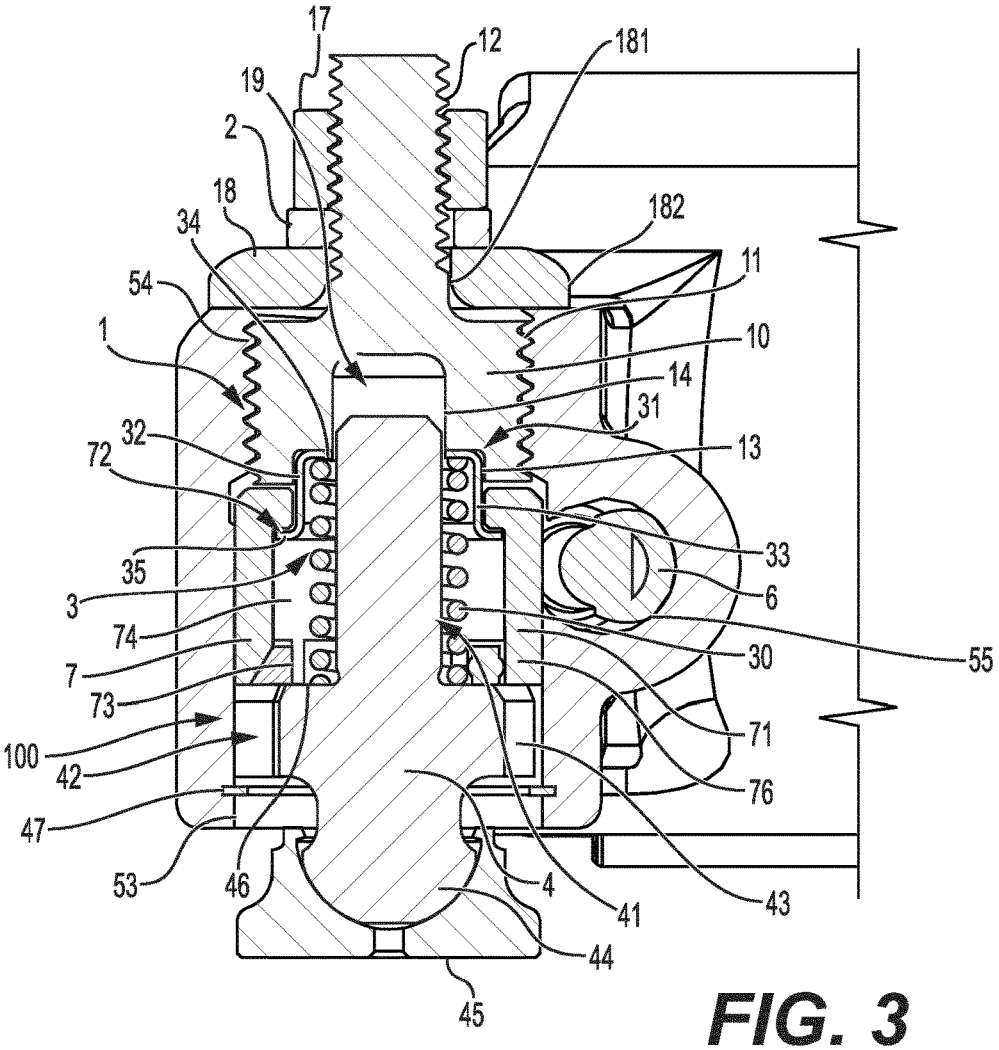
FIG. 3 is a cross-section view of a castellation assembly in a rocker arm with an actuation assembly.
Figure 4A:
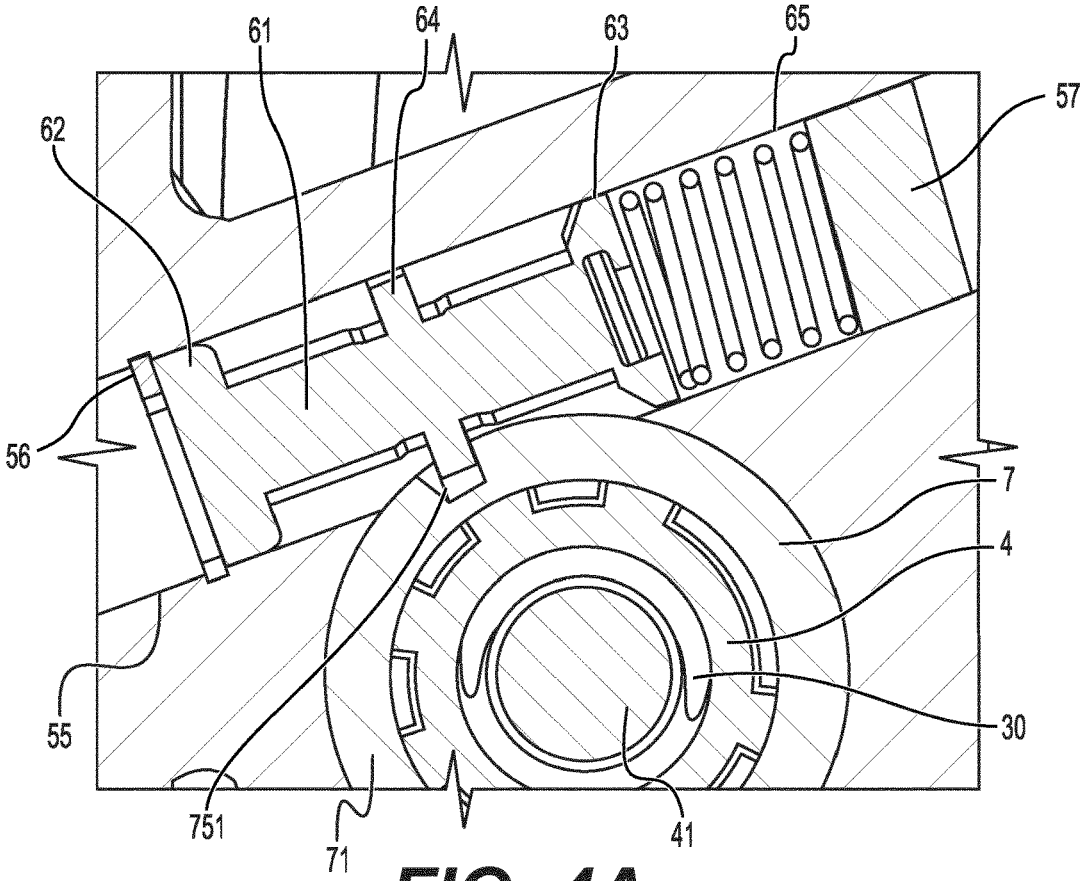
FIG. 4A illustrates an actuation assembly with a castellation assembly.
Figure 4B:
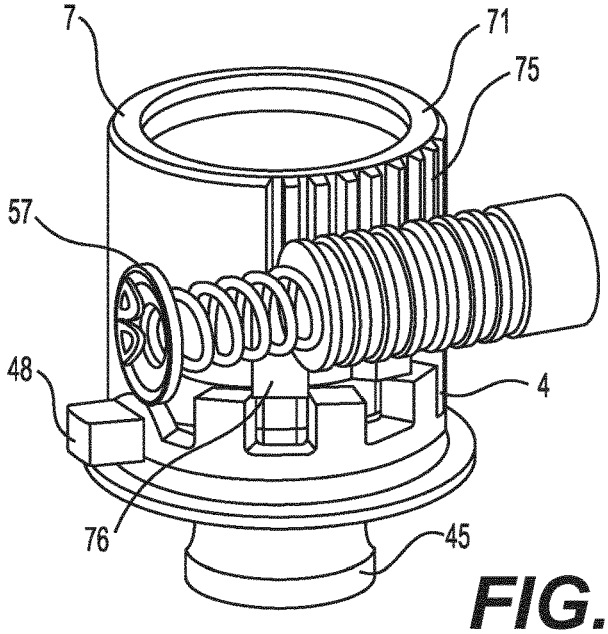
FIG. 4B illustrates a rack and pinion arrangement as an actuation assembly with a portion of the castellation assembly.

In FIGS. 3 & 4A, a plunger end 62 of a piston 61 can be pushed to move by oil pressure and can be biased to return to a starting position against a retainer 56 by an actuation spring 65 against a retainer 57. Retainers 56, 57 can be snap rings, plugs, or end walls of the actuation bore 55. A keyed end 63 can permit installation of the piston 61 in the actuation bore 55. A tool can be used to move the piston 61 and align the upper castellation piece 7. The tool can be held in place while the lash screw 1 is set. Accurate switching is achieved.

Keyed end 63 can oppose actuation spring 65. The piston 61 can be connected, as by an actuation tooth 64, to the tubular body 71, as by an actuator slot 751. When the plunger 62 moves due to control oil pressure, the connected castellation part (tubular body 71) rotates so that its upper castellation teeth 76 will align as selected (with or between the lower castellation teeth 43). The lower castellation piece 4 can comprise an anti-rotation key 48 or other anti-rotation feature to guarantee a relative rotation between the two castellation parts. A travel limit leg 77 in a restrictive groove are additional optional features.

It is also possible to attach a linkage to the plunger 62, as by keying the linkage or extending the size of the plunger 62 to project out of the actuation bore 55. Then, a solenoid or linear actuator could be connected to the plunger 62. Alternative to oil or other hydraulic pressure through oil port 58, a pneumatic pressure system could be employed, as by connecting an air supply hose to the actuation bore 55 at bore end wall 552.

Between the upper and lower castellation pieces 7, 4, there is a lost motion spring 30 which can guarantee that the upper and lower castellation pieces 7, 4 are far enough apart when unloaded so to allow proper activation. This yields a floating castellation design that facilitates easy actuation with less resistance to motion. Floating upper castellation piece 7 allows easy rotation of the actuator piston 61. The upper castellation piece 7 does not drag against the lower castellation piece 4.

Spring hat 31, or other retainer, is positioned between the upper castellation piece 7 and the lash screw 1 with a brim 35 or shoulder to keep the upper castellation piece 7 in a controlled position with no axial load from the lost motion spring 30. The lost motion spring assembly 3 and lower castellation 4 are designed so that the lost motion load is not transferred to the upper castellation piece 7 during lost motion.

Alternative actuation assemblies can be configured, including mechanical, electromechanical, and hydraulic. Hydraulic actuation is shown herein. As alternative to the above actuation assembly 6 is actuation assembly 8. The tubular body 71 can comprise exterior pinion teeth 75 over a portion or all of the exterior. Pinion teeth 75 can be configured to interface with a movable, toothed rack 81. Rack teeth 82 can mesh with pinion teeth 75 to rotate the upper castellation piece 7 when the plunger end 83 is acted on with hydraulic or other control. An actuation spring 84 can bias the position of the rack 81 against a retainer 57, such as a snap ring or plunger. Then, rocker arm can comprise an actuation bore 55 and a rack gear of a rack and pinion arrangement biased in the actuation bore 55. The tubular body 71 can comprises the external pinion gear portion aligned with the rack gear portion.

Figure 5A:
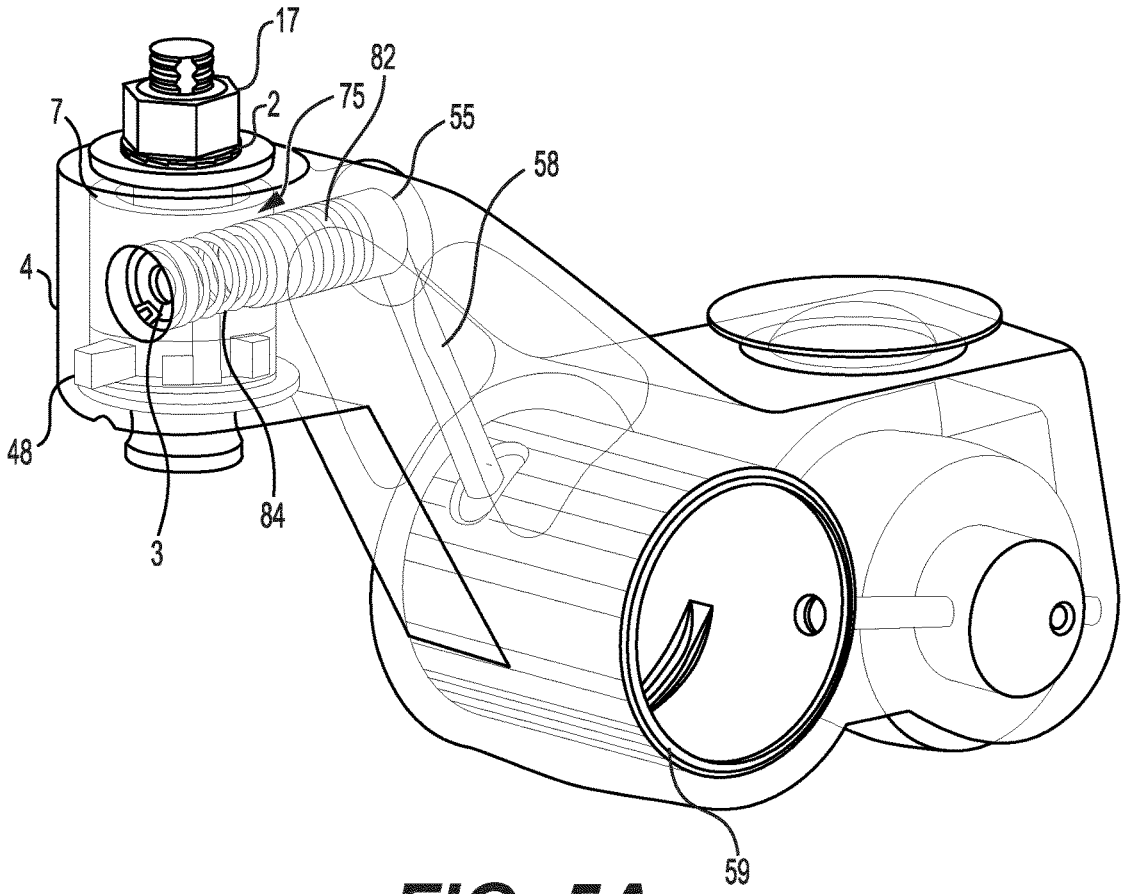
FIGS. 5A-5C illustrate an actuation assembly in a rocker arm.
Figure 5B:
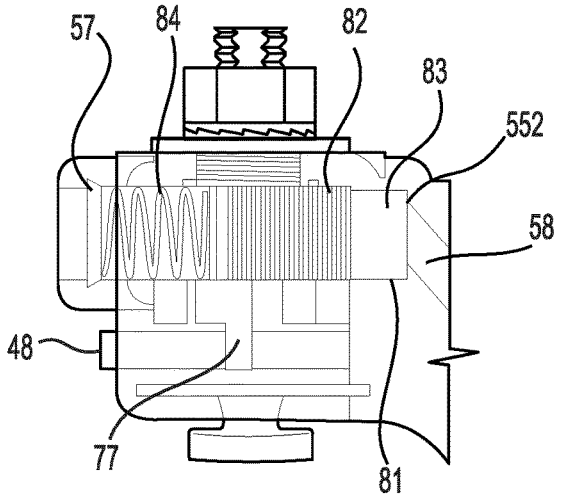
Figure 5C:
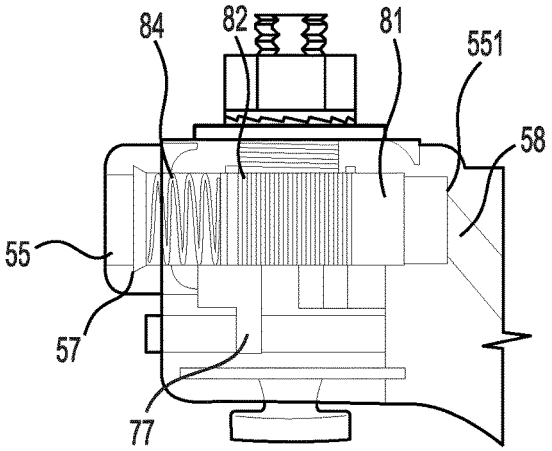
Figure 6C:
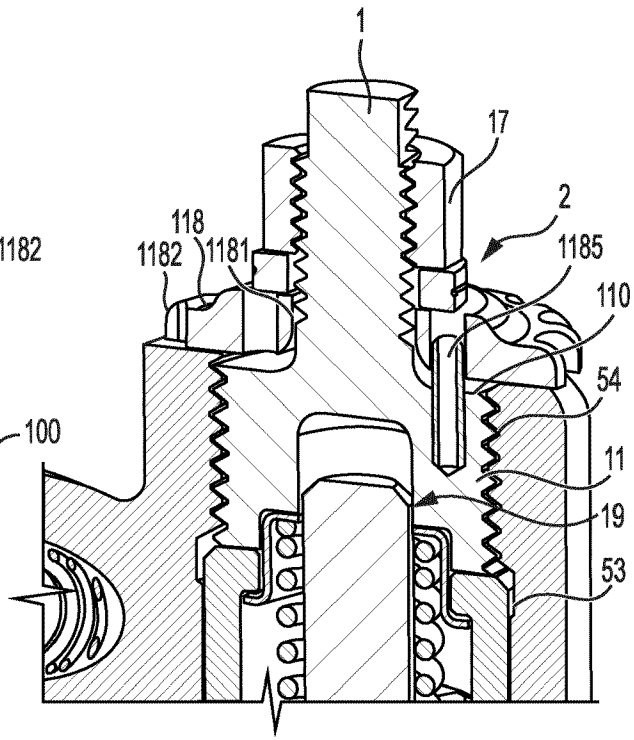
FIGS. 6A-6C illustrate alternative fasteners.
Figure 6B:
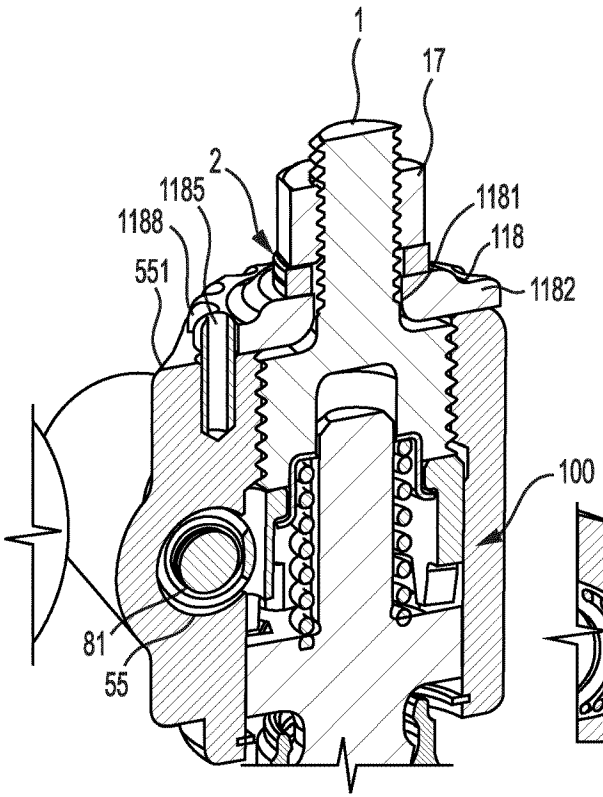
Figure 6A:
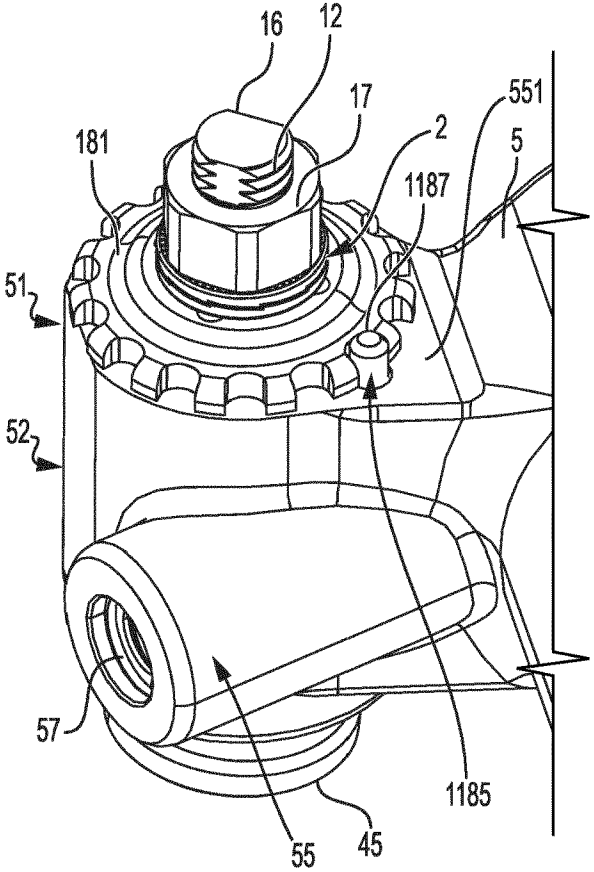

FIGS. 5A-5C illustrate the actuation assembly 8 in a rocker arm 15. A rocker shaft bore 59 can be connected to an oil control valve through a rocker shaft. An oil port 58 from the rocker shaft bore 59 can supply hydraulic control to actuation bore 55. Rack 81 can move in the actuation bore 55. With oil control off (FIG. 5B), plunger end 83 of rack 81 can abut bore end wall 552 of actuation bore 55. Actuation spring 84 can push against retainer 57 to hold the upper castellation piece in a first position (engaged or disengaged as a matter of choice). Then, oil pressure to rack plunger end 83 pushes the rack (FIG. 5C). The actuation spring 84 is pushed against retainer 57 and the rack teeth 82 push on pinion teeth 75 to spin the upper castellation piece 7. The next position can be chosen.

As discussed, rocker arm 5, 15 is an example of a castellation assembly installation. Castellation assembly 100 can be installed in a capsule bore 52, wherein the capsule bore 52 comprises a lash setting bore 54 and an actuation bore 55. The first outer diameter 11 is seated in the lash setting bore 54, and the upper castellation piece 7 and the lower castellation piece 4 are seated in the actuation bore 55.

A rocker arm 5, 15 can also comprise the castellation assembly 100 installed in a capsule bore 52 of a capsule body 551. The first outer diameter 11 can be seated in the capsule bore 52. The second outer diameter 12 can extend out of the capsule bore 52.

Securing the castellation capsule to the rocker arm 5, 15 in a compact and durable manner can be accomplished in alternative ways. The lash screw 1 has a small overall diameter, but good positioning and load tolerance via threads with the capsule bore 52. But, instead of bulk extending upward from the rocker arm, a large diameter washer 18 or star washer 118 can secure the lash screw 1 in place. Yet, a small diameter retaining nut 17 can also be used. Alternative thread sizes can be used on the first and second outer diameters 11, 12 of the lash screw 1.

In a first alternative, several fasteners are adjoined. A washer 18 is seated against the capsule body 551 and partially surrounds the second outer diameter 12. An inner diameter 181 of washer 18 can adjoin the second outer diameter 12 of lash screw 1. An outer diameter 182 of washer 18 can extend radially to cover the capsule bore 52. Stable seating of the rocker arm side 184 of washer 18 can be accomplished against the capsule body 551 and the rocker arm can have a more simple casting and fabrication. Alternative use of pilot holes, blind bores, and through-bores can be used with the castellation assembly 100 and lash screw 1, but the use of washer 18 eliminates some of these steps and costs. A locking assembly 2 can be seated against the lock side 183 of washer 18. Locking assembly 2 can be, for example, a set of NORD LOCK self-locking metal fasteners, namely, bolts, nuts, wheel nuts and lock washers, or like style washers that work in conjunction with the small counter nut 17 to maintain the pretension for the lash screw 1 and prevent loosening in vibration. Locking assembly 2 can comprise a first lock ring 21 and a second lock ring 22. First and second lock teeth 23, 24 can grip one another to prevent counter-rotation of the first and second lock rings 21, 22. Additional lock teeth can be included on the washer side 25 and nut side 26 of the locking assembly 2. A nut 17 is threaded to the second outer diameter 12 and secures the locking assembly 2 against the washer 18. This fastening arrangement is compact and robust.

Additional fastening alternatives can be had. The washer can comprises a toothed star washer 118. Star washer 118 is seated against the capsule body 551 and partially surrounds the second outer diameter 12. An inner diameter 1181 of washer 18 can adjoin the second outer diameter 12 of lash screw 1. An outer diameter 1182 of washer 18 can extend radially to cover the capsule bore 52. Stable seating of the rocker arm side 1184 of star washer 118 can be accomplished against the capsule body 551 when the star teeth 1188 of the star washer 118 cleat or grip into the capsule body 551.

The rocker arm 5, 15 can comprise a stake 1185 pressed between star teeth 1188 of the star washer 118 and into the capsule body 551. Or, the rocker arm 5, 15 can comprise a stake 1185 pressed through the star washer 118 and into a shoulder 110 of the lash screw. Star washer 118 can comprise star teeth 1188 with gaps 1187 therebetween. Shoulder 110 of lash screw 1 or capsule body 551 can be formed with indexing holes. Star washer 118 can be staked to the capsule body 551 via stake 1185, which can be an elastic pin, screw, pin, or the like. Or, an indexing hole can also be formed in the washer 18 or star washer 118 and a stake 1185 can be pushed through the indexing hole into shoulder 110 of lash screw 1. The stakes 1185 can help to prevent the lash screw 1 from rotating.

Other implementations will be apparent to those skilled in the art from consideration of the specification and practice of the examples disclosed herein.

What is claimed is:

1. A castellation assembly, comprising:
- a lost motion spring assembly, comprising:
  - a spring hat, comprising a crown, a pin hole through the crown, and a brim; and
  - a lost motion spring seated against the spring hat;
- an upper castellation piece comprising a tubular body, an upper inner rim adjoining the brim, and upper castellation teeth, the tubular body comprising a lower inner rim configured to guide the lost motion spring; and
- a lower castellation piece, comprising:
  - a spring post extending up from a castellation body, the spring post passing through the lost motion spring, and through the pin hole; and
  - lower castellation teeth extending from the castellation body,
- wherein the lost motion spring is biased against the castellation body to lift the upper inner rim by the brim.

2. The castellation assembly of claim 1, further comprising:
- a lash screw, comprising:
  - a first outer diameter of a lash screw body configured to seat in a lash-setting bore;
  - a second outer diameter of the lash screw body configured to extend out of the lash-setting bore;
  - an inner guiding bore, comprising:
    - a first inner diameter; and
    - a second inner diameter stepped from the first inner diameter;
- wherein the lost motion spring assembly is seated against the first inner diameter, and
- wherein the spring post extends up from the castellation body into the second inner diameter.

3. The castellation assembly of claim 2, wherein the spring post terminates inside the second inner diameter.

4. The castellation assembly of claim 2, wherein the second outer diameter steps down from the first outer diameter.

5. A rocker arm comprising the castellation assembly of claim 2 installed in a capsule bore, wherein the capsule bore comprises a lash setting bore and an actuation bore, wherein the first outer diameter is seated in the lash setting bore, and wherein the upper castellation piece and the lower castellation piece are seated in the actuation bore.

6. The rocker arm of claim 5, wherein the upper castellation piece is biased by the lost motion spring assembly to float above the castellation body of the lower castellation piece.

7. A rocker arm comprising the castellation assembly of claim 2 installed in a capsule bore of a capsule body, wherein the first outer diameter is seated in the capsule bore, and wherein the second outer diameter extends out of the capsule bore.

8. The rocker arm of claim 7, further comprising:

a washer seated against the capsule body and partially surrounding the second outer diameter;

a locking assembly seated against the washer; and a nut threaded to the second outer diameter and securing the locking assembly against the washer.

9. The rocker arm of claim 8, wherein the washer comprises a toothed star washer, and wherein the rocker arm comprises a stake pressed between teeth of the star washer and into the capsule body.

10. The rocker arm of claim 8, wherein the washer comprises a toothed star washer, and wherein the rocker arm comprises a stake pressed through the star washer and into a shoulder of the lash screw.

11. The rocker arm of claim 7, further comprising an actuation bore and a rack gear biased in the actuation bore, wherein the tubular body comprises an external pinion gear portion aligned with the rack gear.

12. The castellation assembly of claim 1, wherein the upper castellation piece is biased by the lost motion spring assembly to float above the castellation body of the lower castellation piece.

13. The castellation assembly of claim 1, wherein the tubular body comprises an exterior actuator slot configured to interface with a movable piston.

14. The castellation assembly of claim 1, wherein the tubular body comprises exterior pinion teeth configured to interface with a movable, toothed rack.

* * * * *